US006338242B1

(12) United States Patent
Kim et al.

(10) Patent No.: US 6,338,242 B1
(45) Date of Patent: Jan. 15, 2002

(54) VENTED MK 66 ROCKET MOTOR TUBE WITH A THERMOPLASTIC WARHEAD ADAPTER

(75) Inventors: Steven S. Kim, Crofton; John R. Luense, Accokeek, both of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/626,070

(22) Filed: Jul. 26, 2000

(51) Int. Cl.[7] ..... F02K 9/00

(52) U.S. Cl. ..... 60/204; 60/223; 60/254; 102/377; 102/481; 220/89.4

(58) Field of Search ..... 60/223, 253, 254, 60/204; 102/481, 377; 220/89.4

(56) References Cited

U.S. PATENT DOCUMENTS

| | | | | |
|---|---|---|---|---|
| 3,927,791 A | | 12/1975 | Hershberger | 220/89 B |
| 4,557,198 A | | 12/1985 | Hickey | 103/481 |
| 4,991,513 A | | 2/1991 | Malamas et al. | 102/481 |
| 5,035,180 A | | 7/1991 | Purcell et al. | 102/481 |
| 5,035,182 A | | 7/1991 | Purcell et al. | 102/481 |
| 5,036,658 A | * | 8/1991 | Tate | 60/253 |
| 5,155,298 A | | 10/1992 | Koontz | 102/481 |
| 5,311,820 A | | 5/1994 | Ellingsen | 102/481 |
| 5,337,672 A | | 8/1994 | Boissiere et al. | 102/481 |
| 5,398,498 A | | 3/1995 | Mort et al. | 60/223 |
| 5,735,114 A | | 4/1998 | Ellingsen | 60/39.1 |
| 5,939,662 A | | 8/1999 | Bootes et al. | 102/473 |
| 6,038,979 A | * | 3/2000 | Watson | 102/481 |

OTHER PUBLICATIONS

Kim, S.T., "Vented MK 66 Rocket Motor Tube with Thermoplastic Warhead Adapter" Naval Warfare Surface Center Apr. 29, 1998.

* cited by examiner

*Primary Examiner*—Charles G. Freay
*Assistant Examiner*—Ehud Gartenberg
(74) *Attorney, Agent, or Firm*—Mark Homer

(57) ABSTRACT

An ordnance venting system has an ordnance device having a casing with a vent opening, a dome plug fitted into the formed vent opening and an adapter fitted over the dome plug on the outside of the casing. The adapter connects sufficiently to the casing to retain the dome plug against the formed vent opening for given pressures. The adapter melts at high temperatures and releases the dome plug to reduce the danger of explosion from heat induced overpressurization.

18 Claims, 1 Drawing Sheet

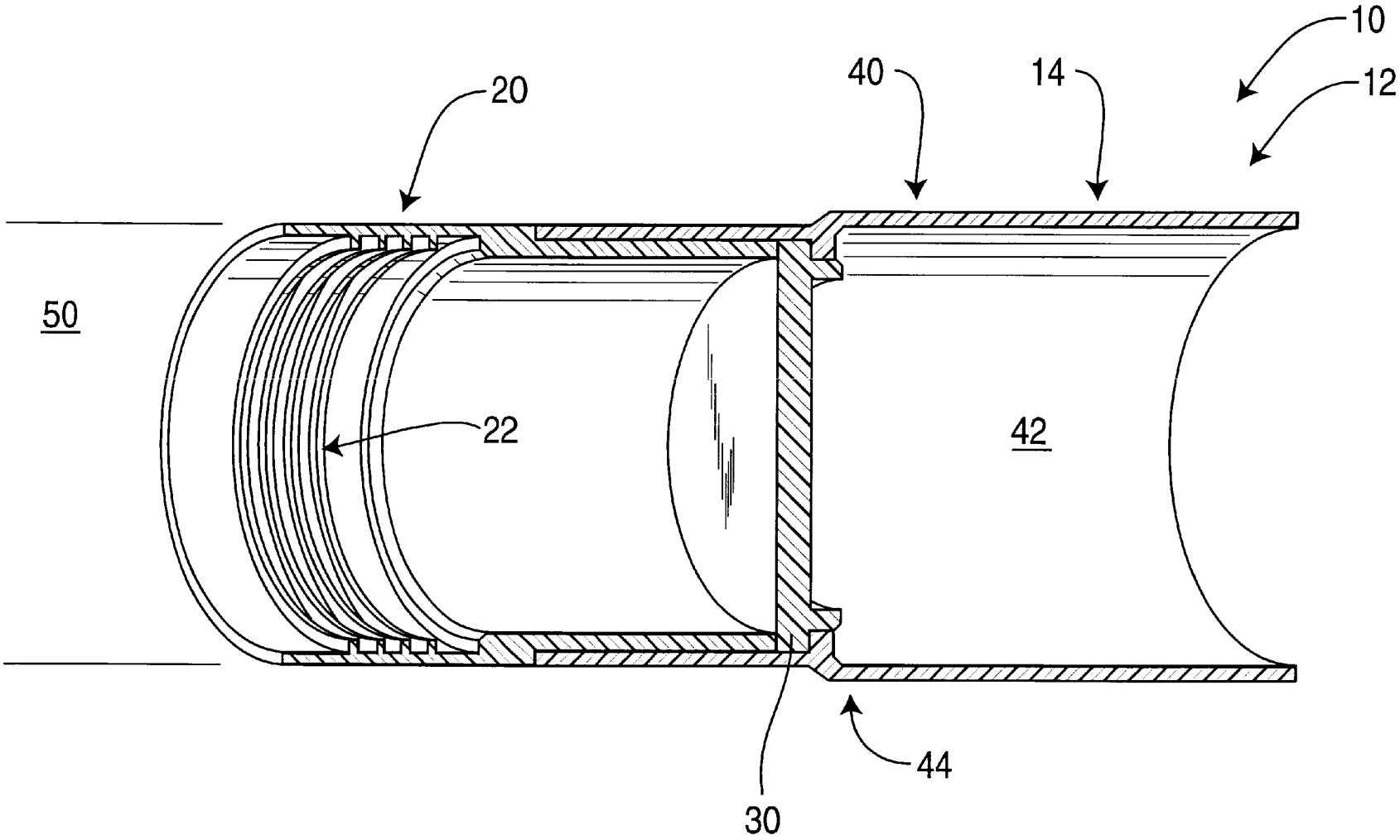
10
12
14
40
42
44
30
20
22
50

VENTED MK 66 ROCKET MOTOR TUBE WITH A THERMOPLASTIC WARHEAD ADAPTER

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to rocket motors. More particularly, the rocket motor of the present invention includes an ordnance venting system to reduce the danger of explosion for heat induced over-pressurization. Most particularly, the ordnance venting system has a thermoplastic warhead adapter that melts prior to rocket cook-off to prevent cook-off.

2. Brief Description of the Related Art

The MK 66 Rocket Motor is a 2.75-inch diameter weapon system used by the United States armed services that is stored and operated from land and sea. Stringent cook off requirements improve safety to personnel and property in the event that an ordnance system is initiated by excessive heat.

Several patents disclose munition venting systems. U.S. Pat. No. 3,927,791 (Hershberger) discloses a fusible plug assembly of a bismuth alloy that melts at approximately 210° F. to permit venting. U.S. Pat. No. 4,557,198 (Hickey) discloses a venting aperture with two retaining means and a shear pin configuration. U.S. Pat. No. 4,991,513 (Malamas, et al.) discloses a plurality of vent holes in the nose section that are open when coincident with vent holes in a collar. In storage, the vent holes are left open with the placement of a safety pin, which is removed immediately prior to loading. U.S. Pat. No. 5,035,180 (Purcell, et al. '180) discloses a venting system having a metal patch attached to the casing that shears from the casing when heated. U.S. Pat. No. 5,035,182 (Purcell, et al. '182) discloses a vent system having a bi-metallic patch attached to the casing that deforms with heating, which then separates from the casing. U.S. Pat. No. 5,155,298 (Koontz) discloses a solder plug that melts which retracts a snap ring and confines the explosive material by an adapter plate; with increase in warhead internal pressure, radial set screws shear freeing the adapter plate which release and vent the pressure within the warhead case. U.S. Pat. No. 5,311,820 (Ellingsen) discloses a melting fusible material that allows a free-loaded spring retainer to push the melted or liquid fusible material out of a set screw hole, causing the nozzle to separate from the case at the interface. U.S. Pat. No. 5,337,672 (Boissiere, et al.) discloses a set of locking screws that secures a casing to a plug, with the locking screws designed to shear at a given pressure. U.S. Pat. No. 5,398,498 (Mort, et al.) discloses a fusible helical joint member made of a metallic material having a low melting point that melts when heated, allowing an adapter ring to disconnect the warhead from the rocket motor. U.S. Pat. No. 5,735,114 (Ellingsen) discloses a bimetallic retaining ring that releases the engagement between two or more sections of a rocket motor when contacted by an external heat source. U.S. Pat. No. 5,939,662 (Bootes, et al.) discloses explosive blowout ports that allow heat to enter the fuse body and slowly burn booster charged explosives allowing the explosives to burn off quickly without exploding.

Although the identified patents disclose several types of missile venting devices, none of the patents disclose a non-complex reliable pressure released plug that improves the MK 66 rocket motor's response to insensitive munition (IM) threats, such as fast cook-off, slow cook-off, bullet impact, fragment impact and sympathetic detonation. The present invention addresses these and other needs.

SUMMARY OF THE INVENTION

The present invention includes an ordnance venting system to reduce the danger of explosion from heat induced over-pressurization comprising an ordnance device having a casing with a vent opening formed therein, a dome plug fitted into the formed vent opening, wherein the dome plug completely covers the formed vent opening and an adapter fitted over the dome plug on the outside of the casing, the adapter connected sufficiently to the casing to retain the dome plug against the formed vent opening, wherein the adapter melts at high temperatures.

The present invention also includes a method of venting an ordnance device comprising the steps of providing an ordnance venting system to reduce the danger of explosion from heat induced over-pressurization, comprising an ordnance device having a casing with a vent opening formed therein, a dome plug fitted into the formed vent opening, wherein the dome plug has sufficient width to cover the formed vent opening and an adapter fitted over the dome plug on the outside of the casing, the adapter connected sufficiently to the casing to retain the dome plug against the formed vent opening, wherein the adapter melts at high temperatures, and melting the adapter at a predetermined temperature, wherein pressure within the casing ejects the dome plug from covering the formed vent opening, release the pressure from within the casing.

The present invention further includes a vented ordnance device product produced from the method comprising the steps of providing an ordnance venting system to reduce the danger of explosion from heat induced over-pressurization, comprising an ordnance device having a casing with a vent opening formed therein, a dome plug fitted into the formed vent opening, wherein the dome plug has sufficient width to cover the formed vent opening and an adapter fitted over the dome plug on the outside of the casing, the adapter connected sufficiently to the casing to retain the dome plug against the formed vent opening, wherein the adapter melts at high temperatures, and melting the adapter at a predetermined temperature, wherein pressure within the casing ejects the dome plug from covering the formed vent opening, release the pressure from within the casing, and the vented ordnance device is sufficiently vented to prevent cook-off.

BRIEF DESCRIPTION OF THE DRAWINGS

FIG. 1 illustrates the MK 66 Rocket Motor with the ordnance venting system of the present invention.

DETAILED DESCRIPTION OF THE PREFERRED EMBODIMENT

The present invention includes a thermoplastic warhead adapter that prevents a propulsive reaction and over pressurization within a rocket motor tube. With the melting of the warhead adapter, the rocket motor vents the rocket motor reactants forward, as well as through the rocket nozzle. This forward venting improves Insensitive Munitions (IM) performance of the rocket motor by providing a cook-off pressure release mechanism which increases safety to property and personnel by mitigating the rocket motor's reaction to IM stimuli. The present invention may be incorporated into any suitable rocket motor, such as the MK 66 Rocket Motor.

Referring to FIG. 1, an ordnance venting system 10 of the present invention is shown. The ordnance venting system 10 includes a MK 66 Rocket Motor or other suitable rocket motor 12 having warhead adapter 20 pressing a dome plug 30 onto a motor tube 40 of a casing 14. On the opposite side of the warhead adapter 20 from the motor tube 40, a warhead 50 is attached. The ordnance venting system 10 reduces the danger of explosion from heat induced over-pressurization by melting the warhead adapter 20 during cook-off, which releases the dome plug 30 to vent the motor tube 40. With the exposure of the warhead adapter 20 to high temperatures, the dome plug 30 is released from the motor tube 40. Propellant 42 retained within the motor tube 20 is vented during cook-off of the rocket motor 10.

The warhead adapter 20 of the present invention presses against the dome plug 30, forcing the dome plug 30 to cover a venting area formed by the motor tube 40. The warhead adapter 20 attaches the motor tube 40, with proper attachment determinable by those skilled in the art, such as a screw mechanism or a recessed area that intermeshes with motor tube 40. With the attachment of the warhead adapter 20, the motor tube 40 is sealed, i.e., covering, by the dome plug 30. The vent opening of the motor tube 40 is configured to provide the large and immediate venting of the propellant 42 during cook-off. At the forward end 44 of the motor tube 40, the formed venting area allows energized propellant 42 to be released or expelled without activation of the rocket motor 12. The dome plug 30 fits onto and completely seals this venting area of the motor tube 40, i.e., the dome plug 30 retains a physical seal on the venting area without structural or chemical bonding between the dome plug 30 and forward end 44 of the motor tube 40. The warhead adapter 20 possesses a melting temperature sufficiently below the cook-off temperature of the propellant 42 to allow the warhead adapter 20 to significantly deteriorate and weaken to structurally fail prior to cook-off and release propellant 42 from the motor tube 40 through the venting area (vent opening) formed in the motor tube 40. Preferably the warhead adapter 30 comprises a thermoplastic composition and directly contacts the dome plug 30 for increasing simplicity and reliability of the system. This contact preferably is along the outer edge of the dome plug 30 which is pressed in a ring imprint from the thermoplastic warhead adapter 20. The thermoplastic warhead adapter 20 preferably comprises from about 20 percent or more, more preferably from about 20 percent to about 50 percent, most preferably approximately 30 to 40 percent, glass filled polycarbonate for proper melting, with the proper composition of the thermoplastic composition determinable by those skilled in the art in light of the disclosure herein. The glass preferably comprises from about 20 weight percent or more of the polycarbonate, in amounts such as from about 20 weight percent to about 50 weight percent, or from about 30 weight percent to about 40 weight percent. The glass filled polycarbonate provides strength and temperature characteristics suitable for rocket motor 12 use. The thermoplastic warhead adapter 20 is preferably formed from injection molding to maximize the strength of the thermoplastic warhead adapter 20.

The dome plug 30 seals a venting area formed at the forward end 44 of the motor tube 40. Preferably, the dome plug 30 comprises a singular piece formed as a circular structure with a diameter larger than the diameter of the venting area formed at the forward end 44 of the motor tube 40. Additional fitting grooves, extensions, or other like modifications may be incorporated into the dome plug 30, with the type of modification to the dome plug 30 determinable by those skilled in the art.

On the opposite side of the dome plug 30 from the motor tube 40, the warhead adapter 20 attaches the warhead 50 onto the motor tube 40, with proper attachment determinable by those skilled in the art, such as a threading or screw mechanism 22 or other like means.

Within the MK 66 Rocket Motor, the formed vent opening preferably comprises a diameter of approximately 1.9 inches and the warhead adapter 20 preferably comprises a diameter of approximately 2.4 inches. The length of the warhead adapter 20 is approximately 2.5 inches. The preferred melt temperature of the warhead adapter 20 ranges from about 250° F. to about 300° F.

The present invention includes a method for venting the ordnance device 10 which provides the ordnance venting system 10, previously described, and exposing the ordnance venting system 10 to a heated environment having sufficient temperature elevation to melt the warhead adapter 20. With the melting of the warhead adapter 20, at a predetermined temperature, the dome plug 30 unseats from sealing or covering the vent opening in the motor tube 40 and the pressure within the motor tube 40 has a passage to escape from the confines of the motor tube 40 which reduces the danger of explosion from heat induced over-pressurization. As pressure within the motor tube 40 increases, the dome plug 30 becomes increasingly more removed from the vent opening, allowing increasing amounts of pressure to discharge from inside of the motor tube 40.

In operation, the vent opening within the motor tube 40 is sealed with the dome plug 30 which is fitted onto the formed vent opening. The warhead adapter 20 is fitted against the dome plug 30 on the opposite side of the motor tube 40 and connected sufficiently to the casing 14 of the rocket motor 12 to retain the dome plug 30 against the formed vent opening. When the ordnance venting system 10 is exposed to sufficiently high temperatures, the warhead adapter 20 melts at a predetermined temperature to effectively break the structural integrity sufficiently to release the dome plug 30 with increased pressures within the motor tube 40. Preferably, the warhead adapter 20 melts at a temperature of from about 150° F. to about 350° F., more preferably from about 225° F. to about 330° F., and most preferably from about 250° F. to about 300° F. As the pressure within the motor tube 40 increase, the dome plug 30 becomes increasingly displaced from sealing the vent opening while allows greater pressure release from the motor tube 40. Displacement or ejection pressures preferably comprise a pressure of from about 5% to about 15% of the maximum expected operating pressure of the ordnance device, with the most preferred displacement or ejection pressure being approximately 5% of the maximum expected operating pressure of the ordnance device. Once the warhead adapter 20 is melted and the pressure becomes released from the motor tube 40, the vented ordnance device poses a significantly reduced threat to personnel and property with a reduced danger of explosion from heat induced over-pressurization.

EXAMPLE

A design/development test program was conducted on the present invention. The test was conducted to determine whether heat transfer during motor operation would prematurely activate the venting system. The present invention was successfully subjected to leak, hydroburst, and high temperature release tests. The invention passed a 15 psi leak test. Additionally, the invention withstood a hydroburst pressure greater than 1.5 times the maximum expected operating pressure of the MK 66 rocket motor, and passed the high temperature test with release temperatures of approximately 300° F. An analysis of the test results showed that the invention has adequate strength to secure the dome plug for normal MK 66 motor operation and demonstrated proper release temperature for venting the MK 66 rocket motor.

The present invention mitigates the MK 66 rocket motor's reaction to IM threats by opening the forward end of the motor tube using a thermoplastic of 50% glass filled polycarbonate. The release of the warhead adapter prevents cook-off, when the rocket motor is subjected to high temperature from a slow or fast cook-off threat, by melting and allowing the dome plug to eject. This leaves the forward end of the motor tube open to vent prior to propellant reaction. The melt temperature is above the motor operational temperature, for example 200° F., and below the propellant autoignition temperature, for example 370° F. This improves the safety of the rocket motor, such as the MK 66 Rocket Motor, with the present invention compatible with standard MK 66 Rocket Motors, allowing their continued use without affecting ballistic performance. Injection molding of the thermoplastic warhead adapter allows manufacturing with low cost and mass production. The present invention improves safety to personnel and property, particularly aboard warships and other vessels.

The foregoing summary, description, examples and drawings of the invention are not intended to be limiting, but are only exemplary of the inventive features which are defined in the claims.

What is claimed is:

1. An ordnance venting system to reduce the danger of explosion from heat induced over-pressurization, comprising:

an ordnance device comprising a solid rocket motor and having a casing with a vent opening formed therein;

a dome plug fitted into the formed vent opening, wherein the dome plug completely covers the formed vent opening; and, an adapter fitted over the dome plug on the outside of the casing, the adapter connected sufficiently to the casing to retain the dome plug against the formed vent opening, wherein the adapter melts at temperatures from about 150 degrees Fahrenbeit to about 350 degrees Fahrenheit.

2. The ordnance venting system of claim 1, wherein the edges of the dome plug contact the adapter.

3. The ordnance venting system of claim 2, wherein the adapter comprises threads that screw onto the formed vent opening.

4. The ordnance venting system of claim 3, wherein the formed vent opening comprises a recessed area that intermeshes with the adapter threads.

5. The ordnance venting system of claim 1, wherein the adapter comprises a thermoplastic material.

6. The ordnance venting system of claim 5, wherein the thermoplastic material comprises polycarbonate.

7. The ordnance venting system of claim 6, wherein the thermoplastic material comprises polycarbonate filled with glass in an amount of about 20 weight percent or more.

8. The ordnance venting system of claim 7, wherein the thermoplastic material comprises polycarbonate filled with glass in an amount ranging from about 20 weight percent to about 50 weight percent.

9. The ordnance venting system of claim 8, wherein the thermoplastic material comprises polycarbonate filled with glass in an amount ranging from about 30 weight percent to about 40 weight percent.

10. The ordnance venting system of claim 1, further comprising a sealing ring.

11. The ordnance venting system of claim 1, wherein the formed vent opening comprises a diameter of approximately 1.9 inch and the adapter comprises a diameter of approximately 2.4 inch.

12. A MK 66 Rocket Motor Tube comprising the ordnance venting system of claim 1.

13. A method of venting an ordnance device, comprising the steps of:

providing an ordnance venting system to reduce the danger of explosion from heat induced over-pressurization, comprising a solid rocket motor having a casing with a vent opening formed therein, a dome plug fitted into the formed vent opening, wherein the dome plug has sufficient width to cover the formed vent opening and an adapter fitted over the dome plug on the outside of the casing, the adapter connected sufficiently to the casing to retain the dome plug against the formed vent opening, wherein the adapter melts at temperatures from about 150 degrees Fahrenheit to about 350 degrees Fahrenheit; and, melting the adapter at a predetermined temperature, wherein pressure within the casing ejects the dome plug from covering the formed vent opening, release the pressure from within the casing.

14. The method of claim 13, wherein the adapter melts at a temperature of from about 225° F. to about 330° F.

15. The method of claim 14, wherein the adapter melts at a temperature of from about 250° F. to about 300° F.

16. The method of claim 13, wherein the ejecting pressure comprises from about 5% of the maximum expected operating pressure of the ordnance device.

17. A vented ordnance device product produced from the method comprising the steps of:

providing an ordnance venting system to reduce the danger of explosion from heat induced over-pressurization, comprising a solid rocket motor having a casing with a vent opening formed therein, a dome plug fitted into the formed vent opening, wherein the dome plug has sufficient width to cover the formed vent opening and an adapter fitted over the dome plug on the outside of the casing, the adapter connected sufficiently to the casing to retain the dome plug against the formed vent opening, wherein the adapter melts at temperatures from about 150 degrees Fahrenheit to about 350 degrees Fahrenheit; and, melting the adapter at a predetermined temperature, wherein pressure within the casing ejects the dome plug from covering the formed vent opening, release the pressure from within the casing, and the vented ordnance device is sufficiently vented to prevent cook-off.

18. The vented ordnance device product of claim 17, wherein the predetermined temperature ranges from about 250° F. to about 300° F.

* * * * *